United States Patent [19]

Csont

[11] 4,426,060

[45] Jan. 17, 1984

[54] APPARATUS AND METHOD FOR CONSTRUCTING MODULAR CONCRETE SHELL HOUSING UNITS

[76] Inventor: Ernest Csont, 1941 - NW. 36th St., Oakland Park, Fla. 33309

[21] Appl. No.: 269,323

[22] Filed: Jun. 1, 1981

[51] Int. Cl.[3] ..... E04G 11/02

[52] U.S. Cl. ..... 249/13; 249/82; 249/178; 249/183; 249/185

[58] Field of Search ..... 249/13, 16, 18, 22, 249/28, 142, 144, 152, 159, 161, 163, 178, 183, 184, 82

[56] References Cited

U.S. PATENT DOCUMENTS

| | | | |
|---|---|---|---|
| 2,936,504 | 5/1960 | Harris | 264/31 |
| 3,405,903 | 10/1968 | Sullivan | 264/31 |
| 3,490,729 | 1/1970 | Luce | 249/27 |
| 3,558,095 | 1/1971 | McNiel | 249/13 |
| 3,693,927 | 9/1972 | Jennings | 249/11 |
| 3,742,102 | 6/1973 | Stickler | 264/32 |
| 3,778,953 | 12/1973 | Delorean | 264/31 |
| 3,815,861 | 6/1974 | Maier | 249/19 |
| 3,822,853 | 7/1974 | Shelley | 249/27 |
| 3,847,341 | 11/1974 | Stickler | 249/27 |
| 3,993,720 | 11/1976 | Burdett | 264/33 |
| 4,029,287 | 6/1977 | Burdett | 249/27 |
| 4,127,254 | 11/1978 | Kahan | 249/22 |

*Primary Examiner*—John A. Parrish

*Attorney, Agent, or Firm*—Benjamin W. Colman

[57] ABSTRACT

Apparatus and method for constructing a modular concrete shell housing unit in which complementary counterpart form assemblies are detachably connected on a supporting concrete floor slab at their inner adjacent longitudinally extending framing members, the form assemblies having first means for rolling movement longitudinally on the floor slab and second means for elevating, leveling and lowering the framing and superstructure of the form assemblies from and to the floor slab and for rolling movement of the assemblies transversely thereon toward and away from each other. An inner wall form and roof form are respectively movable and fixed components of each form assembly, the inner wall form being translatable laterally outwardly and inwardly with respect to the framing structure. A pivoting roof edge plate section is hingedly mounted to and at the lateral distal edge of the roof form. The two form assemblies, when connected, can be hauled on said first rolling means from one floor slab to another adjacent floor slab by conventional drawing means.

44 Claims, 23 Drawing Figures

APPARATUS AND METHOD FOR CONSTRUCTING MODULAR CONCRETE SHELL HOUSING UNITS

BACKGROUND OF THE INVENTION

The invention relates to concrete shell type housing units and more particularly to the equipment, apparatus and method for producing such a unit comprising a pair of spaced apart side walls and a conjoined gable roof.

Various apparatus for producing modular concrete shell type housing have been designed and used in the construction industry for a very long period of time. Modular building units are built with apparatus that can be continually reused to produce concrete shells for such housing units. But such apparatus takes a variety of forms and a considerable amount of labor, a fair part of which must be relatively skilled. Unless the forms for modular concrete shells are designed for a minimum of skilled labor, there is usually little if any saving over the cost of concrete shell housing construction by conventional means and procedures.

Many forms used for constructing modular concrete shell units are collapsible and designed for assembly and disassembly within the housing unit. Considerable time for erection and disassembly of such forms is incurred for many of these prior art systems; such time and the skilled or relatively skilled labor required significantly increase the cost of these housing units.

SUMMARY OF THE INVENTION

The invention involves apparatus and method for producing modular concrete shell housing units. The apparatus comprises an assembly unit of complementary forms defining the interior surfaces of the shell housing unit. The interior roof and outer wall forms, defining one-half of the housing unit, are mounted on movable framing and assembled into a unit structure. This unit is mounted on wheels so that the framing assembly can be rolled onto the concrete floor slab upon which the shell unit will be positioned and secured. The two form assemblies, one for each half of the housing unit, are bolted together at their upper and lower inner edge beams, the inner wall forms for the side walls are then projected outwardly into position under pivoting hinged roof plate sections, and the lower panel portions of the inner wall form are removably attached to the inner wall form framing. Concrete reinforcing screening or wires, assembled or in panels, are then positioned upon the floor slab adjacent the inner wall form and upon the roof forms. The outer wall forms are brought into position about the reinforcing screens and secured to the inner wall by conventional ties and/or other suitable means for maintaining the inner and outer wall forms in properly spaced relation. Concrete is then poured or pumped into the wall space between the wall forms and onto the roof forms where it is spread and leveled. Alternatively, the lower portion of the outer wall forms can be dispensed with if concrete is applied to the inner wall forms by the spraying method.

After the concrete has taken a substantial set and begun to harden, the ties are cut, the outer wall forms are removed, the inner wall forms are then withdrawn inwardly upon their supporting framing, the roof forms are lowered, the conjoined form assemblies are withdrawn by tractor from beneath the now hardening housing unit and hauled to the next concrete floor slab.

The two form assemblies generally remain connected together at a location where a number of housing units will be erected, but will be disconnected and hauled away separately where the multi-unit housing project is completed and the new location is at a distance and must be reached by travel on public roads.

These and other objects and advantages of the invention will become more apparent by reference to the following detailed specification to be read in context with the attendant drawings.

DESCRIPTION OF A PREFERRED EMBODIMENT

Figure 1:
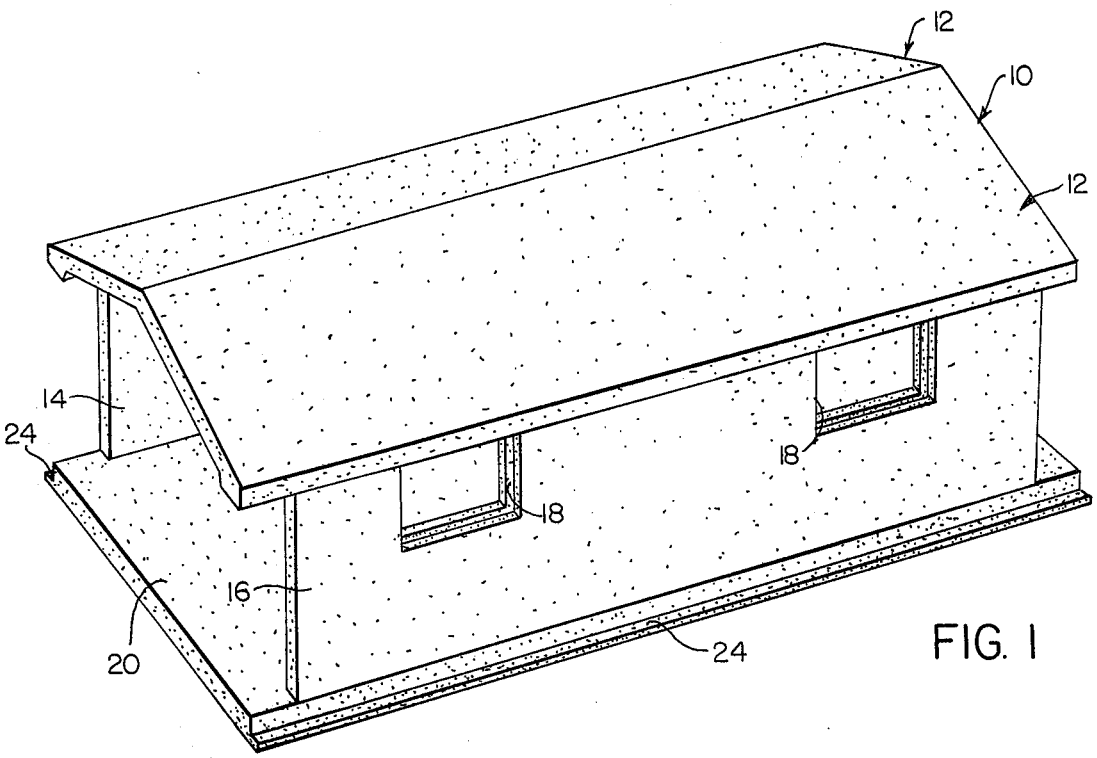
FIG. 1 is a perspective view of a preferred embodiment of the invention, illustrating a modular concrete shell housing unit on a concrete floor slab.
Figure 2:
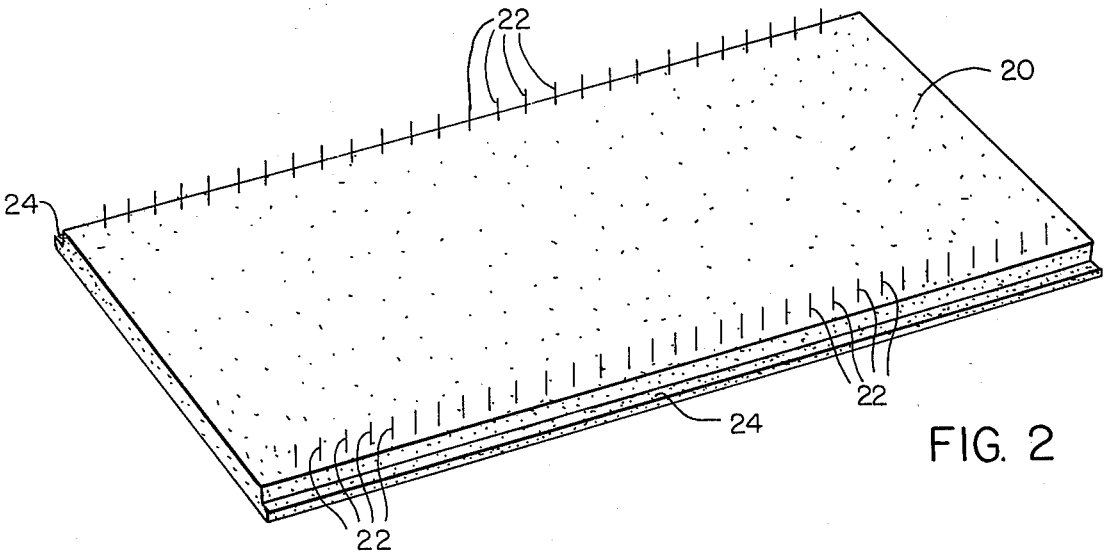
FIG. 2 is a perspective view of the concrete floor slab prepared for positioning of the shell housing form assemblies.
Figure 3:
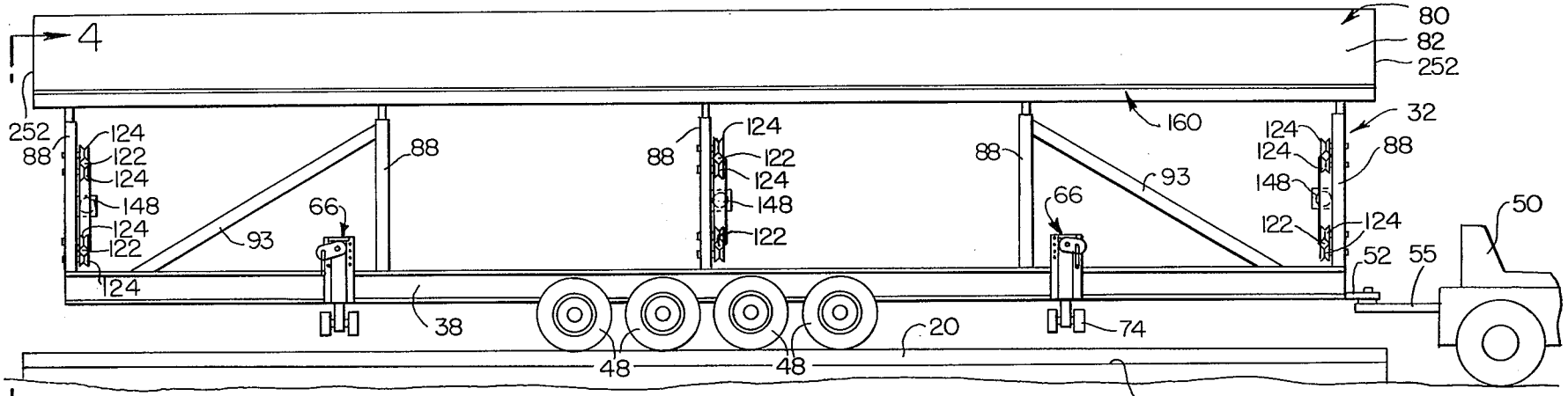
FIG. 3 is a vertical elevational view of a form assembly taken substantially on the line 3—3 of FIG. 4.

A preferred embodiment of the apparatus and method of its use is illustrated in the drawings and described below. The modular concrete shell housing unit 10 (FIG. 1), comprises gable roof sections 12, 12 and side walls 14, 16. The walls can be provided with window openings 18 and/or door openings (not shown). The shell housing unit 10 is positioned upon and secured to a pre-formed hardened concrete floor slab 20 having longitudinally extending laterally spaced apart rows of reinforcing wire steel 22, 22 upstanding from the slab in the area where the walls 14, 16 will be poured or sprayed. Notched ledges 24, 24 adjacent and laterally outwardly of the wire steel 22, 22 are formed in the slab as supporting ledges for the outer wall forms described hereinafter below.

Figure 4:
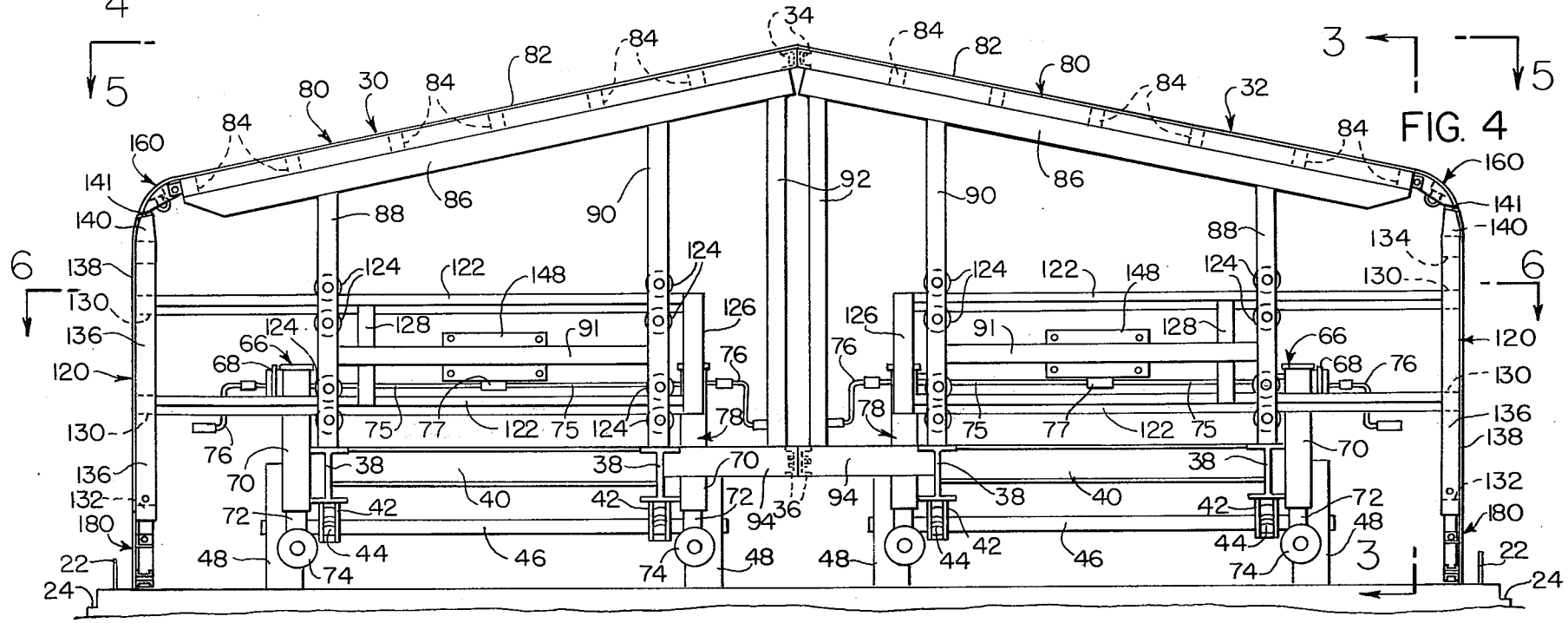
FIG. 4 is an end elevational view of the two form assemblies connected together longitudinally at their inner upper and lower beams, the inner wall forms being extended laterally into position under the pivoted roof form section, taken substantially on the line 4—4 of FIG. 3.
Figure 5:
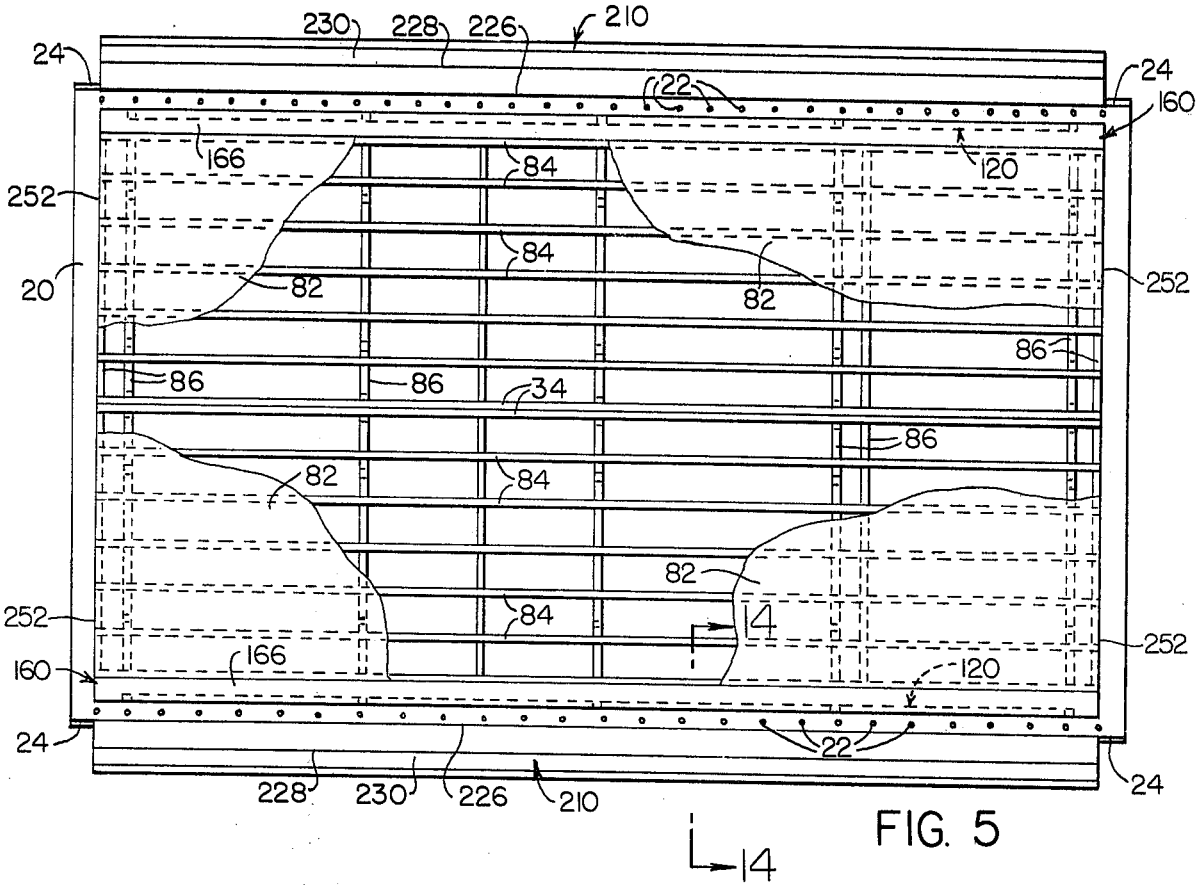
FIG. 5 is a top plan view, on a slightly reduced scale, of the conjoined roof forms, with the roof panels partially broken away to expose the roof form beams, taken substantially on the line 5—5 of FIG. 4.

The apparatus of this invention includes two complementary wall form assemblies 30, 32, obverse and counterpart apparatus respectively for construction of the concrete shell housing unit 10, fully illustrated in drawing FIGS. 3–23 inclusive. Assembly 30 is the obverse or counterpart of the right hand assembly 32, so that substantially identical or similar but oppositely directed or parallel elements or components bear the same reference numerals, it being understood that the structure and function of the counterpart components are identical. As illustrated in FIGS. 4 and 7, the two form assemblies 30, 32 are detachably secured together at their inner upper and lower beams 34, 36 respectively by conventional bolt, nut and washer assemblies.

The form assemblies each comprise main framing having longitudinally running spaced apart main beams 38, 38 connected by transverse beams 40 and supported by shackles 42 and leaf springs 44, attached to the beams 38, 38, for the transverse axles 46 mounting wheels 48.

The form assemblies are rolled one at a time and into adjacent parallel relationship onto the hardened floor slab 20 between the rows of steel rods or wires 22, 22, by means of a power driven machine or tractor 50 pin-connected to the draw plate 52 secured to and at one end of each form assembly. Form assembly 32 is further provided with an offset draw plate or member 53 positioned adjacent the inner edge and at one end of the framing, for connection to the coupling member 55 attached to the tractor 50, whereby the two form assemblies, when connected together, can be hauled simultaneously from one floor slab 20 onto another adjacent floor slab.

The form assemblies are each elevated upon their jack mechanisms 66, raising the wheels 48 above the floor slab, so that the two assemblies can be moved laterally on the wheels 74 toward each other. A conventional cable, toggle and ratchet device, engaging the two form assemblies, draws them together so that the male members 54 extending from the cantilevered beams 94 of assembly 32 enter and telescope into the opposing open-ended beams 94 of the form assembly 30 (FIGS. 7 and 8), bringing the upper and lower channels 34, 34 and 36, 36 of both form assemblies into back-to-back contact (FIG. 4) and their upper and lower bolt openings 56, 58 respectively (FIG. 12) into register for acceptance of and connection by the bolt, nut and washer fasteners.

Figure 6:
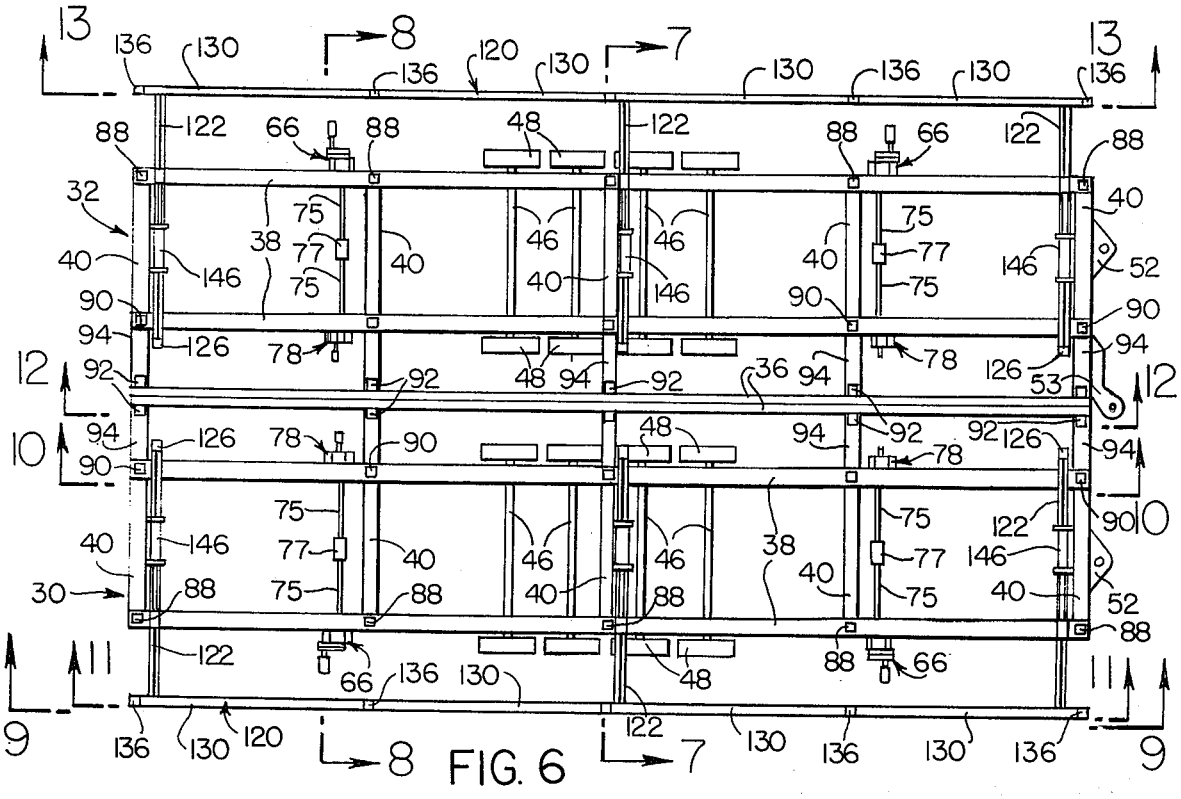
FIG. 6 is a horizontal longitudinal sectional view on a slightly reduced scale, partially in elevation, taken substantially on the line 6—6 of FIG. 4.
Figure 7:
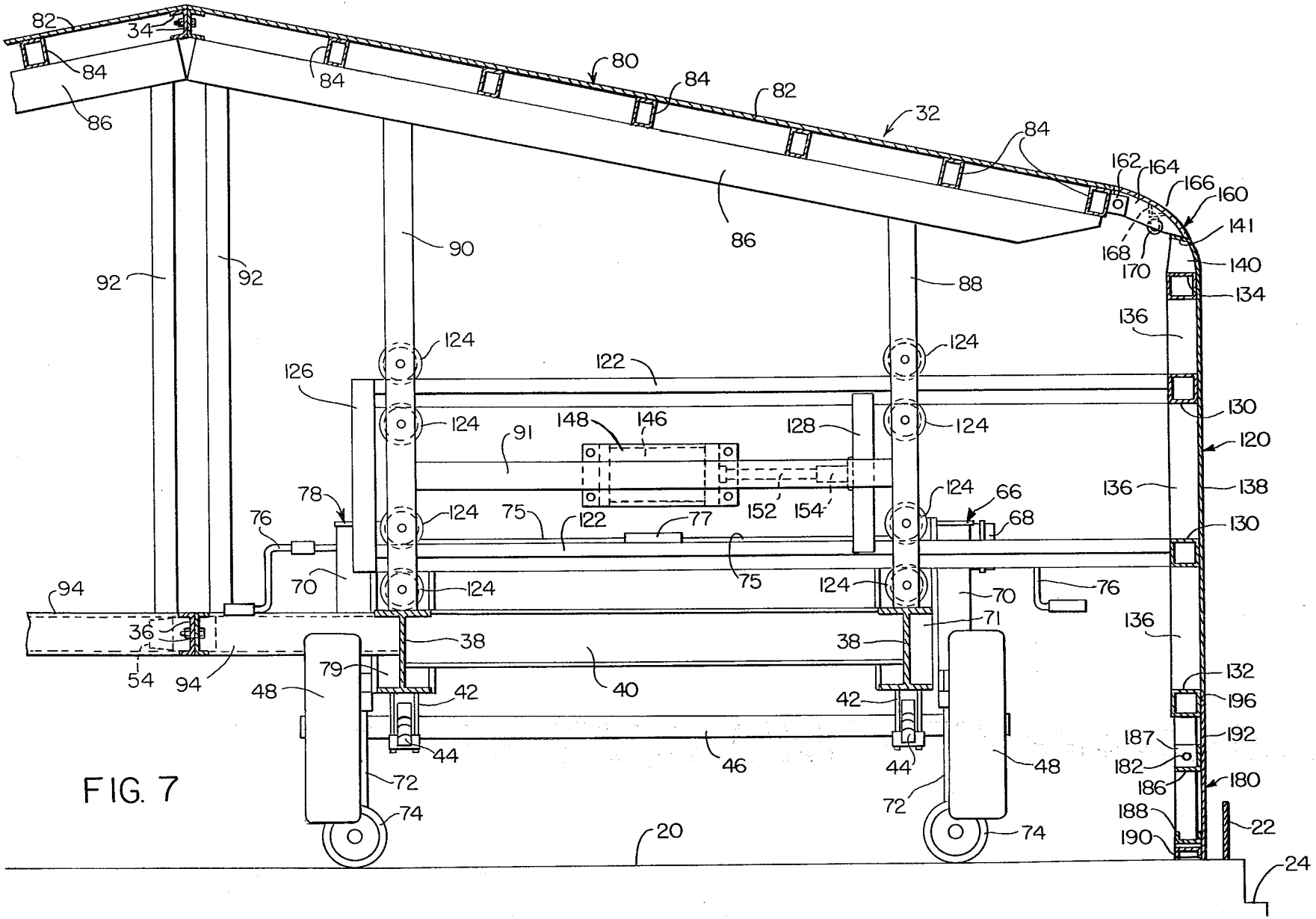
FIG. 7 is a vertical transverse sectional view, substantially medially of one of the form assemblies, now elevated by a jack mechanism, taken substantially on the line 7—7 of FIG. 6.
Figure 8:
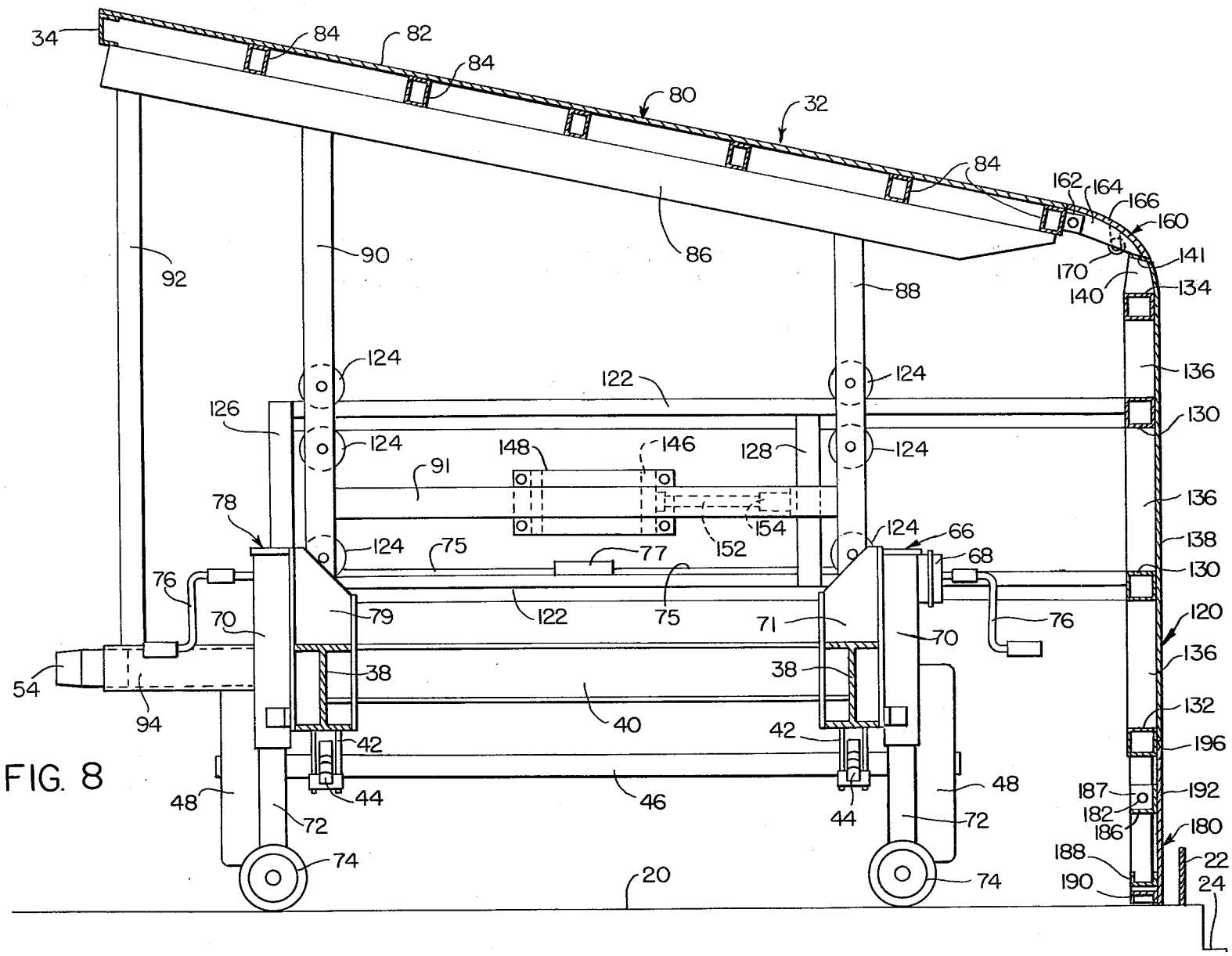
FIG. 8 is a vertical transverse sectional view, similar to that illustrated in FIG. 7, taken substantially on the line 8—8 of FIG. 6.
Figure 9:
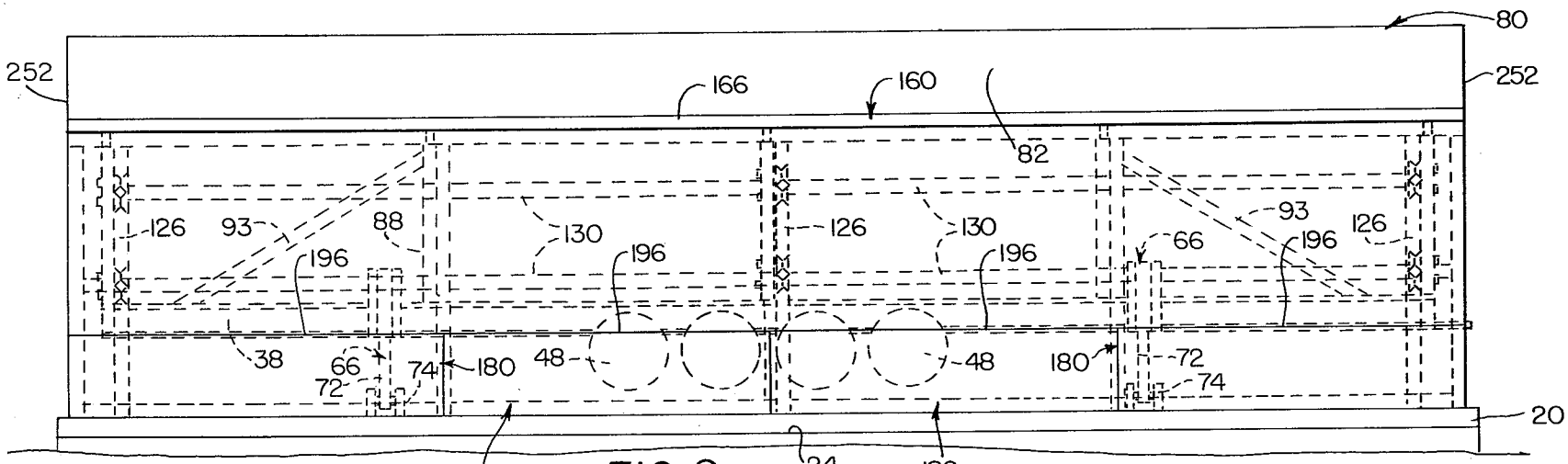
FIG. 9 is a vertical side elevational view taken substantially on the line 9—9 of FIG. 6, but showing the form assembly elevated by the jack mechanisms.
Figure 10:
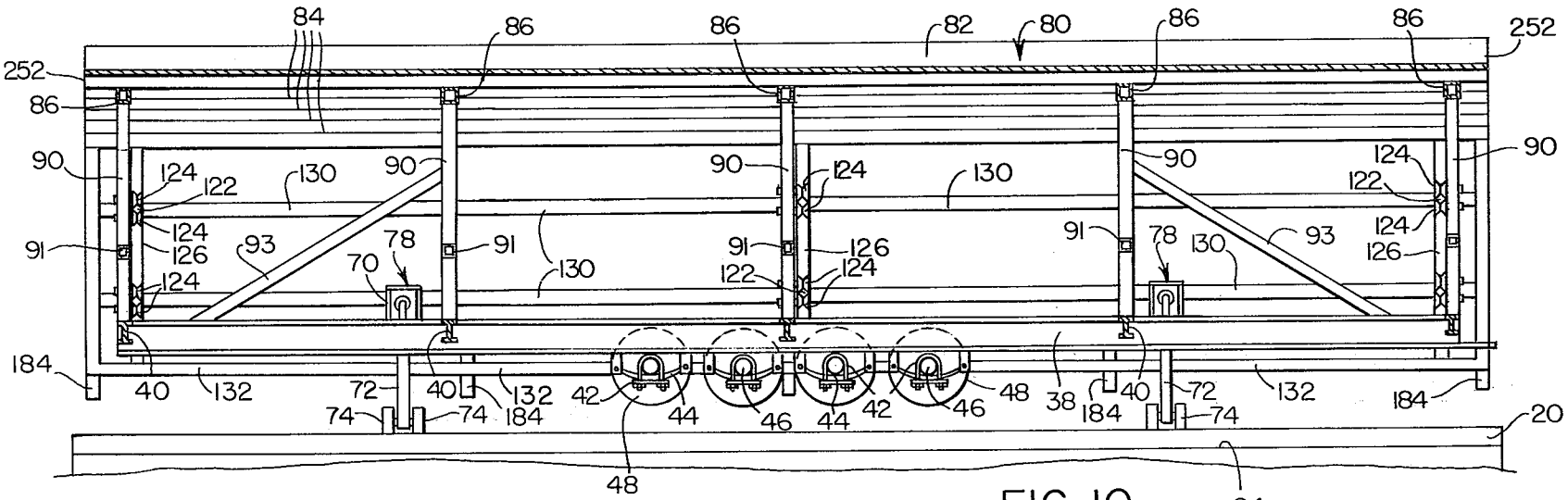
FIG. 10 is a vertical longitudinal sectional view, partially in elevation, taken substantially on the line 10—10 of FIG. 6, but with the form assembly elevated by the jack mechanisms as in FIG. 9.
Figure 11:
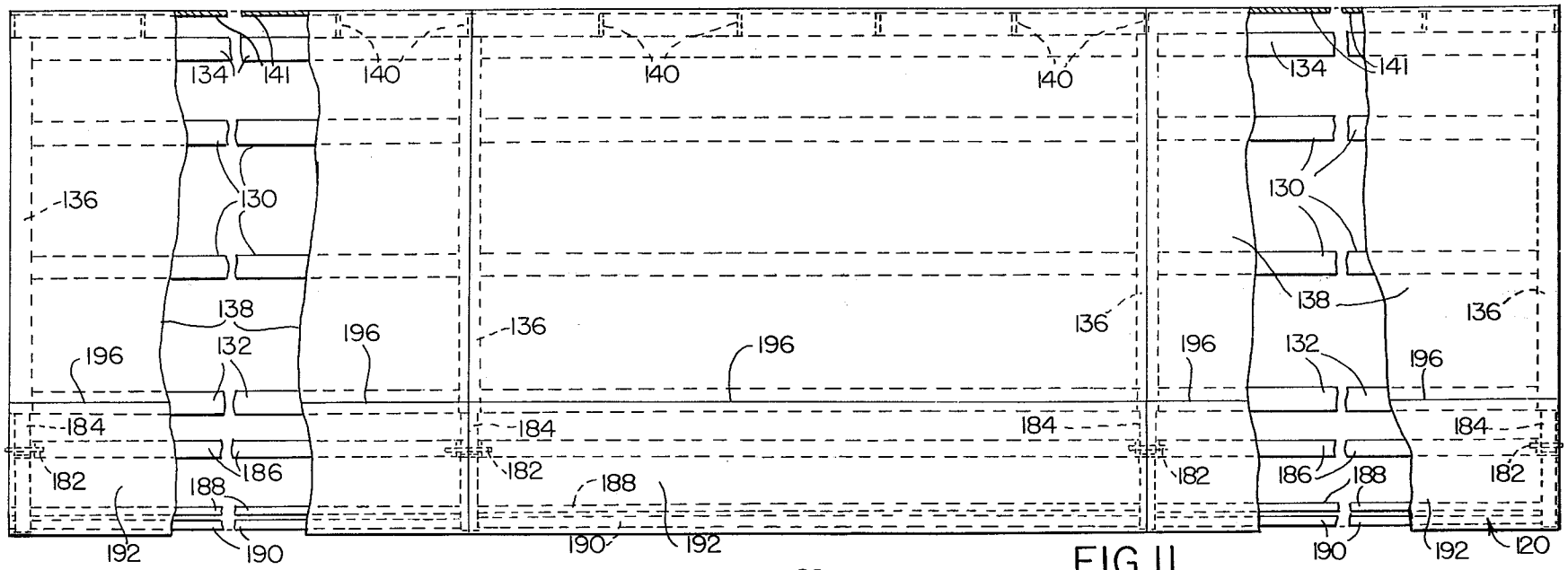
FIG. 11 is a side elevational view of the inner wall form taken substantially on the line 11—11 of FIG. 6.
Figure 12:
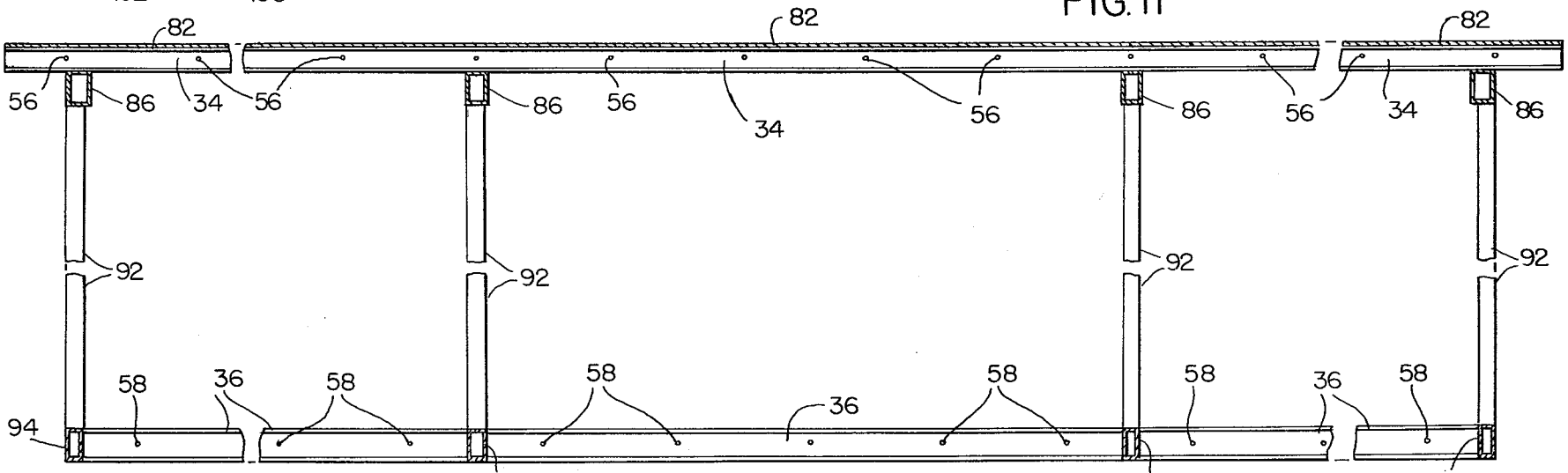
FIG. 12 is a vertical longitudinal sectional view, partially in elevation, taken substantially on the line 12—12 of FIG. 6.

Secured to the outer of the longitudinally extending beams 38 and adjacent columns 88, are a plurality of manually crank operated jack mechanisms 66 for elevating and lowering the two form assemblies (FIGS. 4 and 6). Each jack mechanism 66 comprises a reduction gear box 68 operatively connected to the jack housing 70 to elevate and lower the telescoping tube 72 supporting the transversely-directed rotatable wheels 74 at its lower end. The jack housings 70 are secured to the beams 38 by the channel plates 71. The four jacks 66 are positioned in quadrants of the framing adjacent the outer ends of the transverse beams 40, i.e. adjacent the inner wall form. When crank handle 76 is rotated, the reduction gear box 68 mechanically elevates or lowers the tube 72, through the gearing and rack in housing 70, away from and toward the floor slab 20. The beams 38, 38 and the superstructure mounted thereon are elevated when wheels 74 bear upon the floor slab 20. Simultaneously, the carriage wheels 48 and their supporting structure affixed to the beams are also elevated above the floor slab.

Four supplementary manually crank operated jacks 78, substantially the same as the mechanism 66 but absent the reduction gear box 68, are mounted on the inner main beams 38 by the channel plates 79, adjacent the inner columns 90, to assist the jacks 66, if necessary, in leveling and lowering the form assemblies upon the floor slab, but principally in supporting the roof forms 80, 80 under the load of concrete applied thereto. The jacks 66 and 78 are operatively connected together by rods or tubes 75 having a manually actuated disconnect coupling 77 disposed intermediate the opposing inner ends of the rods. The two roof forms 80, 80 are first elevated to the desired height and leveled by jack mechanisms 66, connecting rods 75, 75 having been disengaged at couplings 77. Jacks 78 are then manually operated so that their wheels 74 bear upon the floor slab, to further support the roof forms under the concrete which is to be applied thereonto.

The roof form 80 comprises a top sheet or panel 82 affixed to and overlying a number of longitudinally extending box beams 84 and the inner channel beam 34. The longitudinal beams 84 are in turn affixed to and supported upon transversely extending box beams 86. Selected beams 86 are supported upon the vertical box columns 88, 90 secured to and mounted upon the longitudinally extending beams 38, 38. A supplementary roof supporting column 92, mounted upon and adjacent the distal end of transverse cantilevered beam 94 supports the inner end of the box beams 86 and the longitudinally extending channel beam 34 thereabove. Horizontal reinforcing struts 91 and angular members 93 are connected to and brace the vertical columns 88 and 90 upon their supporting beams 38.

The inner wall form 120 is supported by a translation mechanism comrising two or more substantially parallel pairs of cantilevered arms or beams 122, 122 disposed horizontally and riding between the rollers 124, 124 rotatably mounted on the columns 88 and 90. The proximal ends of the beams 122 are connected together by the vertical member 126, a vertical member 128 being affixed to and between the beams 122, 122 at a line intermediate the vertical columns 88 and 90. The beams 122 are preferably square tubes whose vertical edge portions ride upon and between the upper and lower pairs of rollers 124.

The distal ends of the traveling beams 122, 122 are connected to the inner wall form horizontal members 130 disposed medially of the wall form 120. The lowermost horizontal member 132 and uppermost member 134 are conjoined to the intermediate parallel members 130, 130 by vertical columns 136. Overlying and affixed to the outer surfaces of the members 130, 132, 134 and the columns 136 is a sheet or sheets of wall plate forming the panel 138 extending upwardly above the member 134 and downwardly substantially to the medial portion of the lowermost horizontal member 132. A plurality of longitudinally spaced apart gusset members 140 are secured to and extend upwardly from the member 134 to the upper inturned edge portion 141 of the wall form panel or plate 138.

To actuate the inner wall form 120 for lateral movement, pneumatic (or hydraulically operated) cylinders 146, responsive to power received from a connected communicating pneumatic (or hydraulic) source, are mounted on plates 148 secured to the horizontal brace members 91 affixed to and between the vertical columns 88 and 90. The distal ends of the cylinder piston rods 152 are each operatively secured to the vertical member 128 at the fitting 154. Upon controlled actuation of the cylinder piston, the rod 152 moves the connected traveling beams 122, 122 and the inner wall form 120 laterally outwardly or draws them back inwardly. Compressed air is supplied to the air cylinders 146 in accordance with the air circuit and control system diagrammatically illustrated in FIG. 23. When the control valves 170 are actuated and opened, the cylinder pistons are retracted and the inner wall form 120 drawn inwardly toward the cylinders, and when the control valves 172 are actuated and opened, the piston rods are propelled outwardly and the inner wall form projected into position under the pivoting roof edge plate section 160 and adjacent the rows of wire steel 22, 22.

Figure 17:
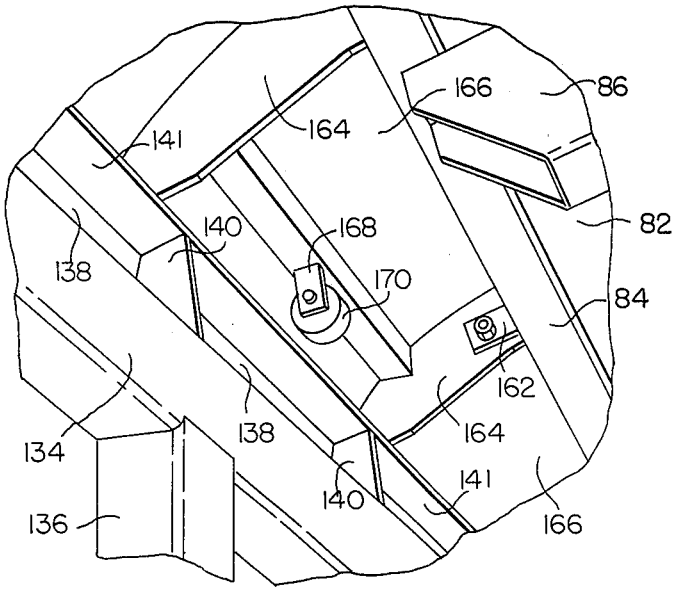
FIG. 17 is a bottom perspective view of the pivoting plate section at the distal edge of the roof form.
Figure 18:
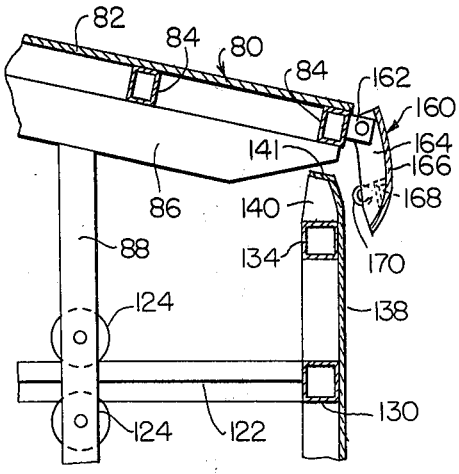
FIG. 18 is a fragmentary vertical sectional view of the pivoting plate section in depending attitude, the inner wall form being adjacent but spaced from the section.
Figure 19:
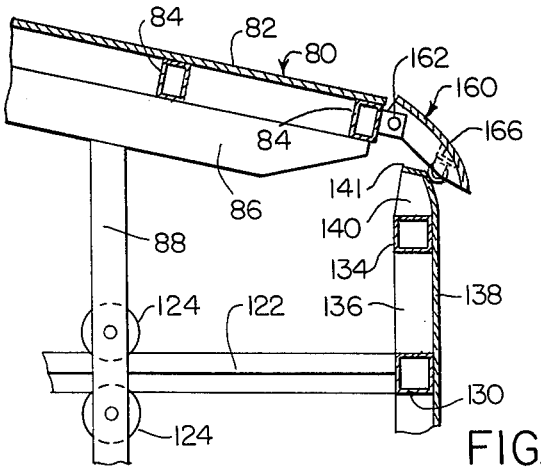
FIG. 19 is a fragmentary view similar to that illustrated in FIG. 18, showing the inner wall form in bearing contact with the rollers on the pivoting plate section.
Figure 21:
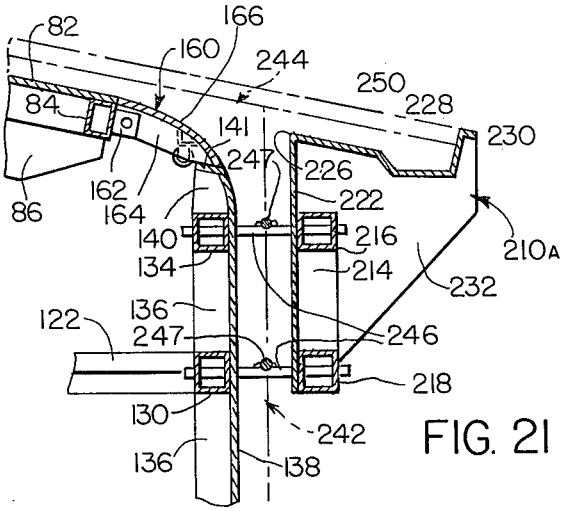
FIG. 21 is a fragmentary vertical sectional view, similar to that illustrated in FIG. 14 but showing a modification of the outer wall form suitable for spraying instead of pouring the side wall.

To blend the concrete roof sections 12, 12 with the concrete side walls 14 and 16, each roof form 80 is provided at is outer distal edge with a pivoting roof edge plate section 160 comprising a plurality of longitudinally spaced apart support brackets 162 secured to the outer vertical surface of the lowermost longitudinally extending roof beam 84, a plurality of longitudinally spaced apart gusset members 164 pivotally attached to the brackets 162 and secured to the underside of the arcuate roof plate 166 (FIGS. 17, 18, 19). When in assembled position, the distal edge of the roof plate 166 abuts the upper edge portion 141 of the inner wall form plate 138 adjacent the gusset members 140 (FIGS. 14, 15, 18 and 19).

The pivoted roof plate section 160 is further provided with a plurality of longitudinally spaced apart bracket members 168 (best shown in FIGS. 17, 18 and 19) secured to the underside of the roof edge plate 166. Rollers 170, which ride upon the inner wall form surface plate 138 as it is translated laterally outwardly by the cylinders 146, are rotatably mounted on the bracket members 168 and elevate the arcuate hinged pivoting roof edge plate section 160 into aligned abutting relationship with the upper edge portion 141 of the inner wall form 120.

Figure 13:
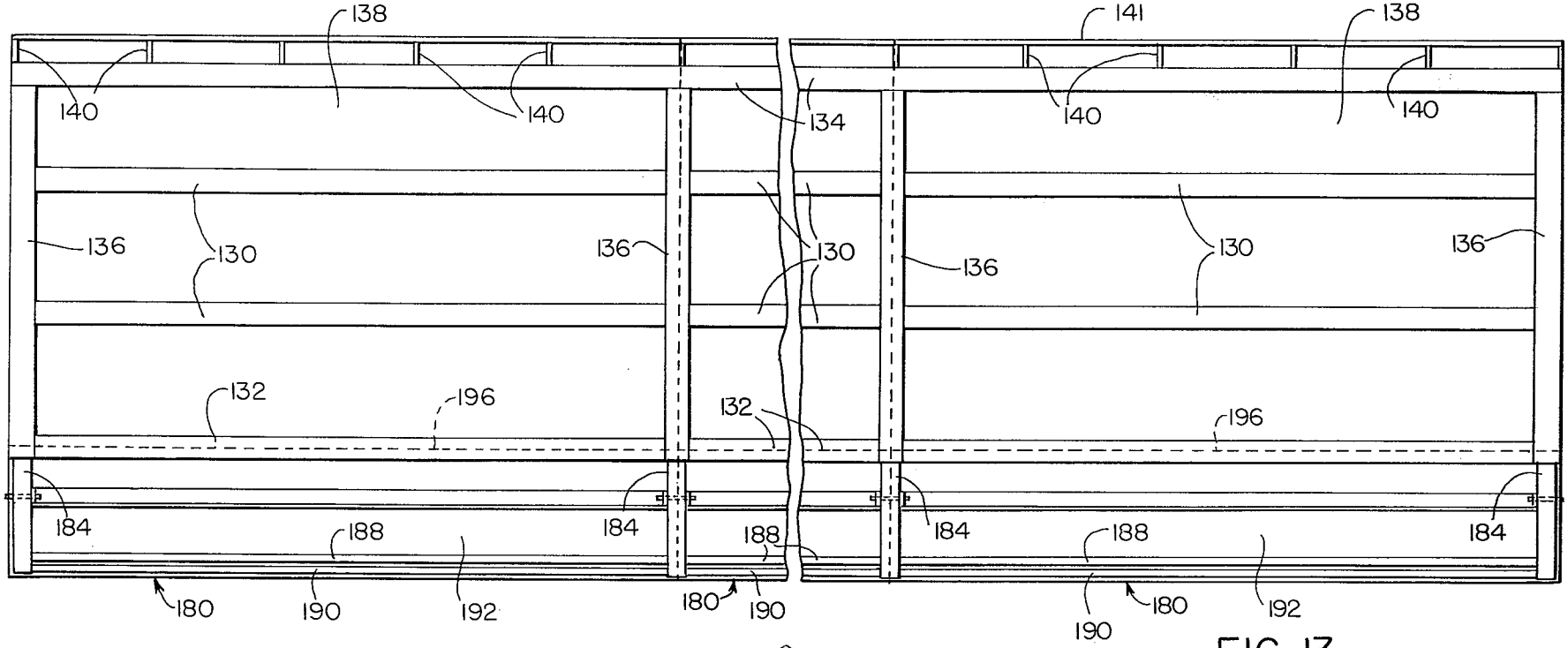
FIG. 13 is an inside vertical elevational view taken substantially on the line 13—13 of FIG. 6.
Figure 22:
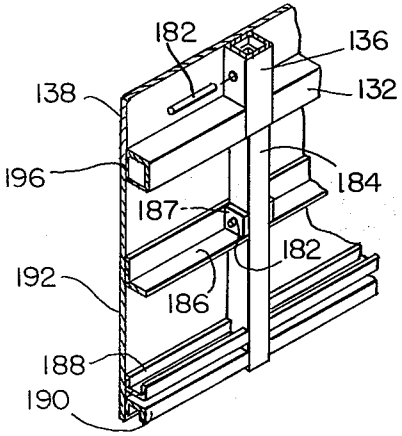
FIG. 22 is a fragmentary perspective view of a portion of the inner wall form bottom section showing the conjunctive structural relationship to the inner wall form.
Figure 14:
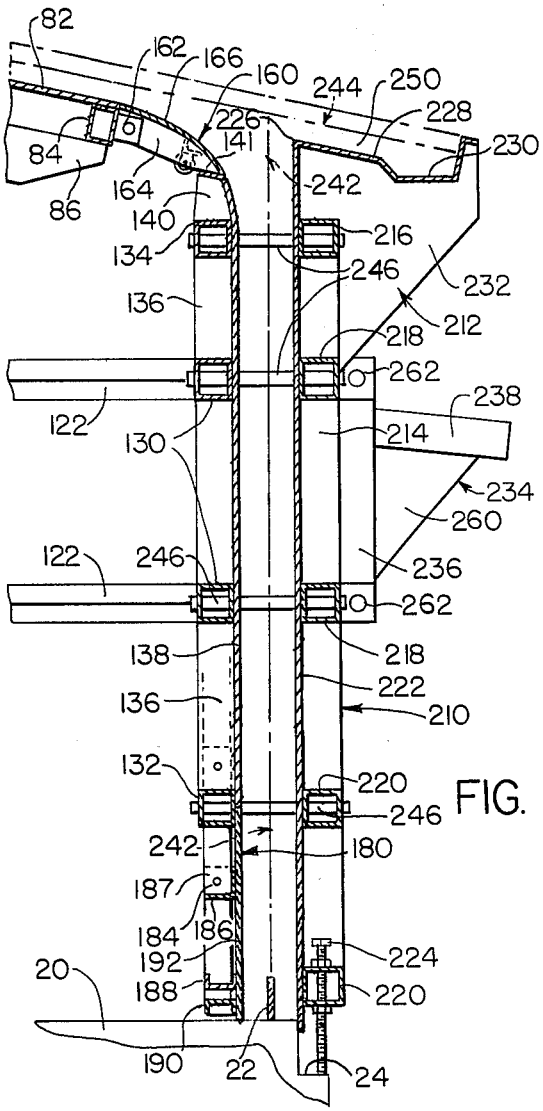
FIG. 14 is a fragmentary vertical transverse sectional view taken substantially on the line 14—14 of FIG. 5.
Figure 15:
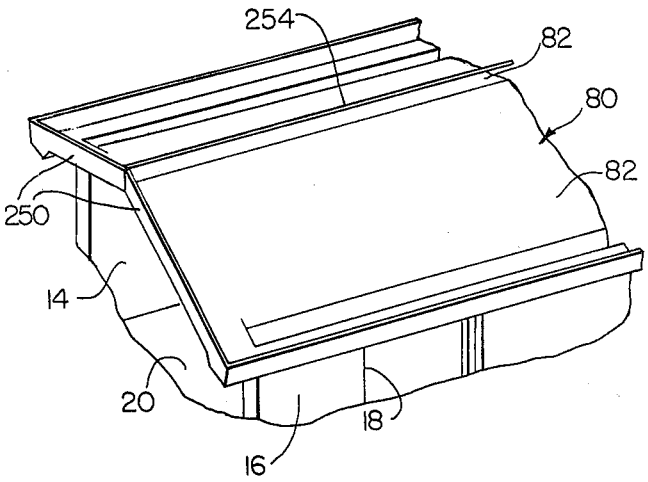
FIG. 15 is a fragmentary perspective view of the roof form arranged with a screed and wire guides for leveling the concrete poured or sprayed onto the roof form.
Figure 16:
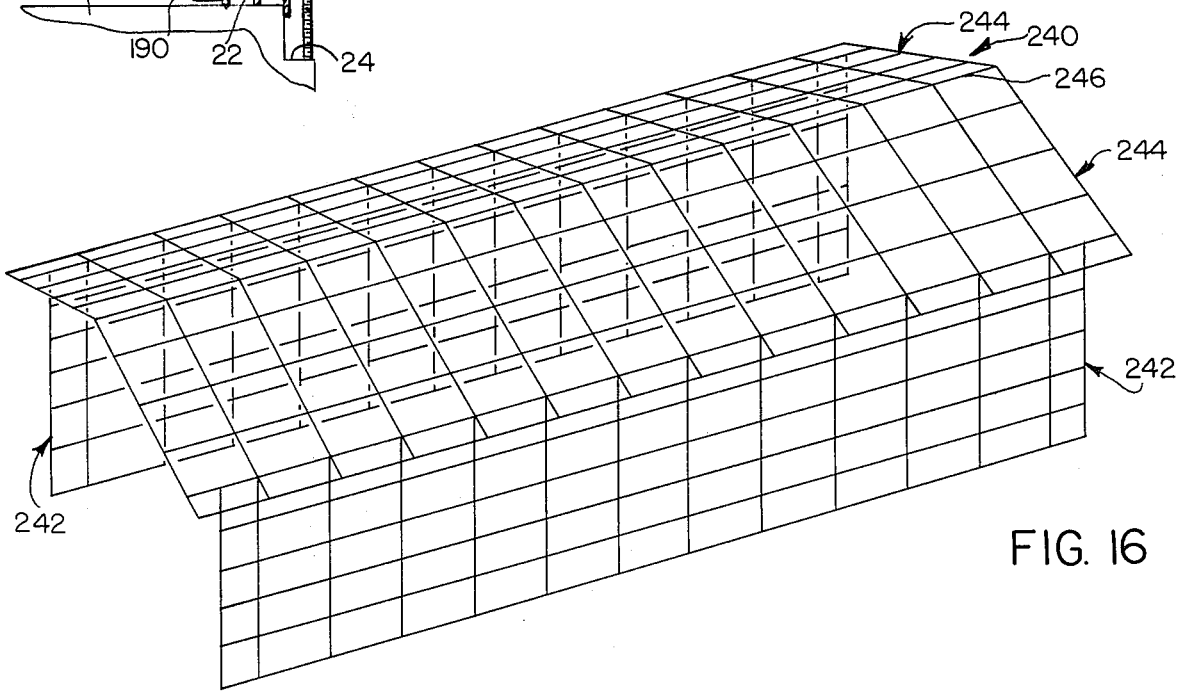
FIG. 16 is a perspective view of reinforcing wire steel arranged for installation between the wall forms and over the roof form as indicated in broken lines in FIG. 14.
Figure 20:
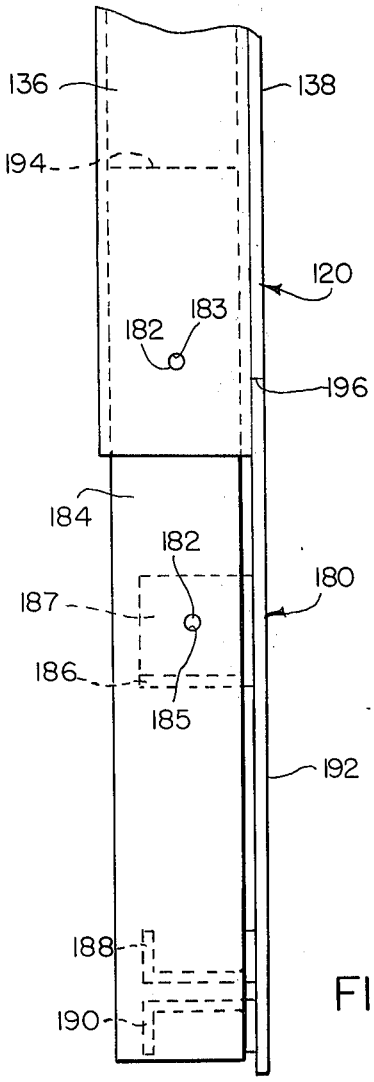
FIG. 20 is a fragmentary vertical end elevational view of the lower end of the inner wall form, with internal members shown in broken line.
Figure 23:
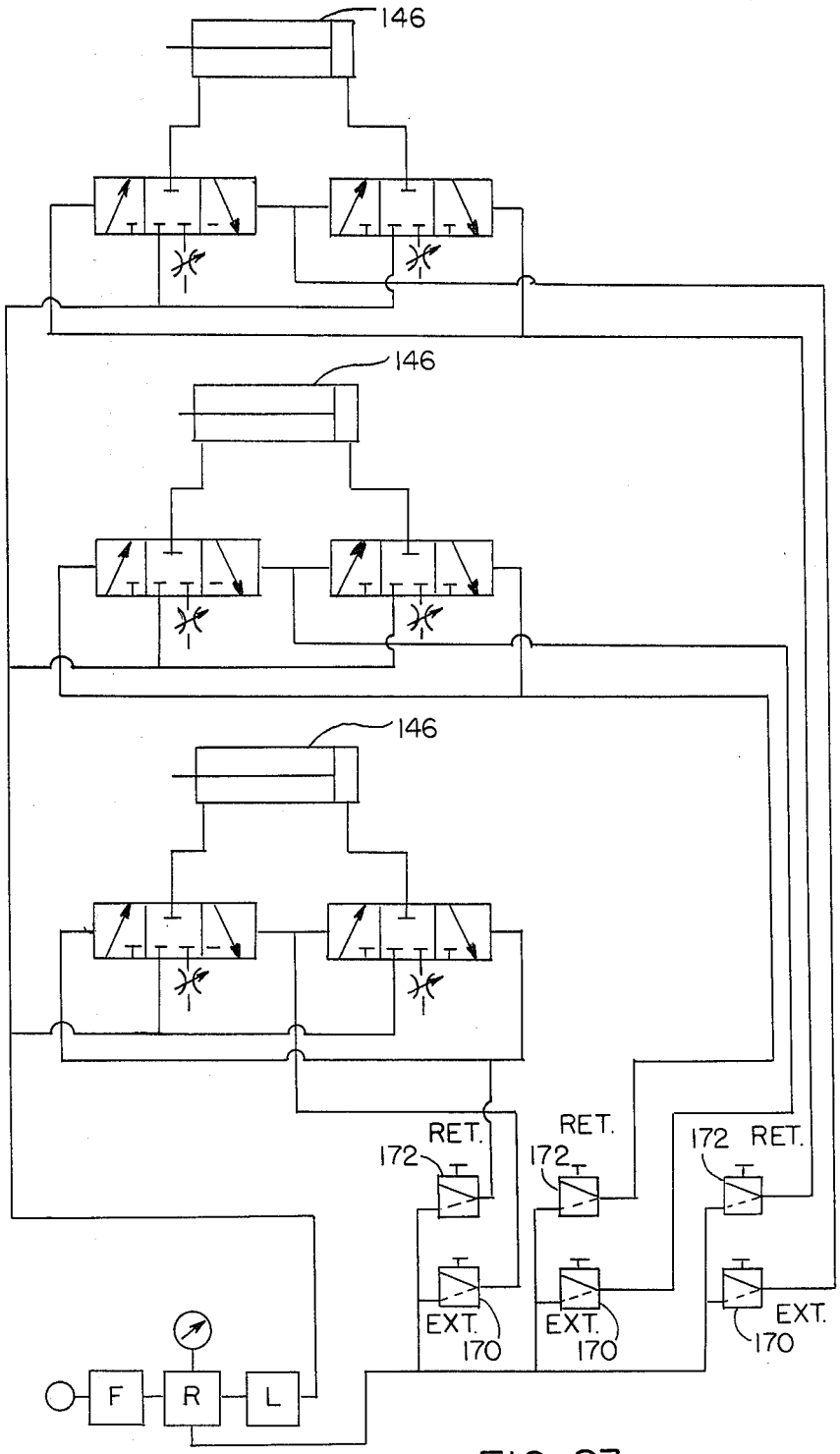
FIG. 23 is a diagrammatic view of the pneumatic circuit for the air cylinders actuating translation of the inner wall form.

The inner wall form 120 is completed in its lower region by manual attachment of a number of inner wall form bottom sections 180 arranged in longitudinal contiguous alignment (FIGS. 20, 22 and 13). The bottom sections 180 are connected together and to the inner wall form 120 by pins 182 removably insertable through openings 183 and 185 in vertical telescoping box columns 136 and the supporting struts 184 respectively. Before attachment of the bottom sections 180, the telescoping box struts 184 are held in the lower regions of columns 136 by pins 182 in the oenings 183. When these pins are removed, the struts 184 drop through slots in the horizontal leg of the longitudinally extending angle member 186 between the vertical plate 187, having openings 185 therethrough for pins 182 which connect the struts to the bottom section 180, and through slots in the lower channels 188 and 190 until the struts are adjacent but spaced slightly from the bottom edge of the wall section plate 192. The vertical leg of the angle member 186 is fixedly secured to the aluminum wall form plate 192 substantially medially thereof by suitable means, as is one of the vertical legs of each of the longitudinally extending channels 188 and 190 disposed adjacent but spaced slightly from the bottom edge of the wall section form plate 192, (FIG. 20). The upper edge of the wall section plate 192, when the bottom section 180 is at rest on the floor slab 20, abuts the lower edge of the wall form panel 138 at the line 196. The wall form bottom sections 180 are built as fractional units of substantially equal length, suitable for manual handling and attachment to the inner wall form 120.

After the inner wall forms 120, 120 with their bottom sections 180 attached, have been set in place on the floor slab 20, at the outer lateral sides of the form assemblies 30 and 32 (FIGS. 7 and 8), a pre-assembled concrete reinforcing steel wire grid unit 240 (FIG. 16) is lifted to a position over the assemblies and lowered to the floor slab 20 on the outside of the inner wall forms 120, 120 and in substantial alignment with the upstanding steel rods or wires 22. The lower ends of the wall grid sections 242, 242 are tied to the wire steel rods 22 (FIG. 14), and the upper edges of the wall grid sections are conjoined to the roof grid sections 244, 244 which are connected together at the ridge 246 and overlie the roof form panels 82 at each side of the conjoined beams 34, 34. The reinforcing steel wire grid unit 240 is made of conventional reinforcing steel rods or wire, generally in some mesh form. The wall grid sections 242 may be applied to the floor slab 20 adjacent the inner wall form 120 separately from the roof grid sections 244 to which they can be wire-tied on the site, or they may be pre-assembled as shown and described. When window and/or door openings are to be provided in the side walls 14 and 16, window and door forms (not shown) are mounted in desired positions on the outer face of the panel 138 and removably secured to the framing of the inner wall form 120. The outer faces of the window and door forms will then abut the inner face of the outer wall form 210 to which they are also removably secured. Of course, portions of the wire mesh of the wall grid sections 242 will be cut out to allow for attachment of the window and/or door forms.

The outer wall form 210 comprises a number of form sections 212 of substantially equal length that can be elevated and placed in position by a fork lift truck or other mechanism or, in some instances, manually. The sections 212 are removably secured together in longitudinal alignment at their lateral edge columns 214 by conventional means such as bolt, nut and washer fasteners, or other suitable means. The horizontal box beams 216, 218 and 220 are fixedly connected to the vertical columns 214, and a facing panel sheet 222 covers and is attached to the inner surfaces of the beams and vertical columns. Vertically disposed through a lowermost horizontal box beam and adjacent each end thereof is a height adjusting screw and nuts 224 whereby the outer wall form section can be leveled upon the floor slab notched ledge 24.

The longitudinally extending upper edge 226 of the panel sheet 222 is connected to and may be integrally formed with the longitudinally extending overhang or roof soffit form 228 which has a slight trough or valley 230 at its distal edge providing a stronger thicker edge to the concrete roof sections 12, 12. The provision of trough 230 in the soffit form is optional. The outer wall form sections 212 are further provided adjacent their lateral ends with gusset plates 232 supporting the outboard soffit forms 228.

Optionally, each of the outer wall form sections 212 may have a lift bracket 234 comprising a pair of spaced apart parallel vertical posts 236. The outwardly projecting members 238 and the gusset plates 260 are secured to the posts 236 affixed to the spaced apart horizontal beams 218, 218. The bracket 234 is disposed substantially medially of the section 212 so that the tines of a fork lift truck can raise and translate the section into position on the notched ledge 24 of the floor slab and hold it in place while wall ties 246 connect it to the inner wall form 120. The lift bracket 234 is removably attached to a wall form section 212 by fasteners affixed to the laterally outwardly projecting members 262.

After the reinforcing steel wire grid unit 240 is in place and set, the unitary sections 212 of the outer wall form 210 are placed on the floor slab ledge and connected together longitudinally by suitable fastening means, and in spaced apart parallel relationship to the inner wall form 120 by conventional wall form ties 246.

A screed 250 is removably affixed to each of the outer lateral ends 252 of the roof forms 80, 80, i.e., to the outer lateral surfaces of the transverse beams 86 at each longitudinal end of the form assemblies 30 and 32. A leveling wire 254 is then removably attached to the spaced apart screeds 250, above the ridge at the juncture of the roof forms, as a guide or rest wire for controlling the thickness of and smoothing the concrete roof sections 12, 12.

When the side walls 14 and 16 are to be made by concrete spraying, the entire outer wall form 210 cannot be used. In such case, the form portion below the gusset 232 and its adjacent horizontal box beam 218 is dispensed with (FIG. 21) i.e. the upper portion, less than one-third of the outer wall form 210, is retained. But before the modified outer wall form portion **210*a* is attached to the inner wall form 120, longitudinally spaced apart wall ties 246 are first affixed to the horizontal box beams 134 and 130 so as to extend horizontally outwardly and a longitudinally extending reinforcing steel wire 247 is fixedly secured to the medial portion of the wall ties so as to maintain them in properly spaced parallel aligned relationship for removable attachment to the modified outer wall form 210*a*. Concrete is sprayed onto the inner wall form panels 138 and 192 to a line at or slightly above the lower distal edge of the pivoting plate section 160, and built up to the desired thickness represented by the distance between the panel sheets 138 and 222. Upon attachment of the outer wall form 210*a*, concrete can be poured or pumped onto the roof forms 80, 80, the soffit form 228 and into the wall space between the pivoting roof plate form section 160 and the outer wall form portion 210*a*** down to the previously sprayed wall portion.

The several forms and form sections are now assembled on the floor slab 20 for pouring or spraying the concrete into the wall areas and upon the roof sections. This step in the process should proceed with reasonable care to the composition and consistency of the concrete mix, the rate at which it is pumped, poured and/or sprayed, the density to which it is to be applied to the forms, and other factors of importance in the act of forming concrete walls and roofs of shell-type housing units, which are well known to persons skilled in the art to which the invention pertains.

The composition of the concrete used in the shell housing unit 10 is variable, depending upon the mode of its application to the form assemblies 30 and 32. Concrete can be pumped, poured or sprayed. In each instance, its composition, consistency and rate of application will differ. Nevertheless, the structure and method of use of the form assemblies 30 and 32 remains the same regardless of which style of applying the concrete may be employed.

METHOD OF USE

The form assembly 30 or 32 is first arranged with its inner wall form 120 retracted toward the distal ends of the roof beams 86, allowing the pivoting roof plate section 160 to depend from its brackets 162 in a generally vertical attitude (FIG. 18). The retraction is effected by actuating the air cylinders 146 which draw the three pairs of movable beams 122 simultaneously inwardly of the form assemblies.

In the method of using the apparatus of this invention and forming the modular concrete shell housing unit 10, each of the form assemblies 30 and 32 is first drawn by a tractor 50 onto a floor slab 20 between the two rows of upstanding reinforcing wire rods 22, 22, substantially into adjacent parallel slightly spaced apart relationship. A cable, toggle and ratchet device draws the form assemblies together so that they can be and are connected at their upper and lower channel beams. The two form assemblies are elevated by jacks 66, independently of and disconnected from the jacks 78, and drawn together at their opposing box beams 94 by the telescoping members 54 which bring the bolt openings 56 and 58 in channels 34, 34 and 36, 36 respectively into register for acceptance of the bolt, nut and washer fastener that tie the two form assemblies together into a unitary structure.

Once the assemblies 30 and 32 are conjoined, the jack mechanisms 66 are hand-cranked substantially uniformly and simultaneously until the roof form plates 82, 82 reach the desired height and are leveled. At that point, the jack mechanisms 78 are operated to support the roof forms 80, 80 for the concrete load to be applied thereto, upon their wheels 74 now firmly at rest on the floor slab 20, and the coupling rods 75, 75 are reconnected by their couplings 77.

The inner wall forms 120 are then moved outwardly by cylinders 146 into positions adjacent the rows of steel wires 22, and the inner wall bottom sections 180 are manually removably attached thereto thereunder. The plates 192 and 138, in alignment, are then substantially parallel with and inwardly of the rows of wire steel 22, 22 and the outer edges of the floor slab 20 at the notched ledges 24. The reinforcing steel grid unit 240 is placed on the floor slab 20 over the roof forms 80, 80 and substantially parallel with but spaced apart slightly outwardly of the inner wall forms 120 and their bottom sections 180. The lower edges of the wall grid sections 242, 242 are wire-tied to the upstanding wire rods 22. The reinforcing steel wire grid unit 240 can be made in a number of ways. The steel rods can be placed in a fixture and wire-tied or welded into a grid arrangement as wall sections 242 and roof sections 244. The wall grid sections 244 can then be erected on the floor slab and wire-tied to the upstanding steel rods 22, and the roof grid sections 242 can be wire-tied at their lateral edges to the adjacent upper edges of the wall grid sections.

The outer wall forms 210 are then placed in position on the ledges 24, 24, adjusted for the height of the floor slab and the roof line by the screws 224 and connected to the inner wall form 120 by wall ties 246.

Window and/or door openings are defined by window and door forms (not shown) removably secured to the outer panel sheet 138 of the inner wall form 120. The outer surfaces of the window and door forms abut the outer wall panel 222. These forms are removably secured to the inner and outer wall forms 120 and 210 according to the conventional practice and by conventional means.

The concrete roof sections 12, 12 may be uniform in thickness throughout, or they may be thicker at the distal edges of the roof forms 80, 80 and slightly thinner at the ridge of the roof. The walls 14 and 16 are substantially of uniform thickness throughout. The cross-sectional thickness of the concrete roof sections 12, 12 is determined in part by the screeds 250 removably affixed by suitable fasteners to the transverse beams 86 at each longitudinal end of the roof forms 80, 80, and by the leveling wire or cable 254 positioned above the ridge at the conjunction of the roof forms, where the leveling wire is supported upon and attached to the screeds.

After the concrete mix has been applied to the roof form and between the wall forms, smoothed to the desired finish, and allowed to set and partially harden, the wall ties 246 are broken at their outer ends and the outer wall forms 210 removed from the walls 14 and 16. The screeds 250, 250 and the ridge leveling wire 254 are removed from the roof forms 80, 80. The window and door forms (if any) are disconnected and removed from the inner wall forms 120. The wall ties 246 are broken inwardly of and from the inner wall form 120. The pins 182 are removed from the pin openings 185 in the upstanding plates 187 of angle members 186 in the bottom sections 180 and from the pin openings 183 in columns 136 of the inner wall form 120. The cylinders 146 are then actuated to draw the inner wall forms 120 inwardly from the walls 14 and 16 and to separate the forms from their bottom sections 180.

Once the inner wall forms 120, 120 are retracted, the pivoting roof form sections 160 again depend from their brackets 162. The roof forms 80, 80 can be and are then partially lowered by the jack mechanisms 66 and 78, recoupled for simultaneous operation by couplings 77.

Now, the two form assemblies 30 and 32, still connected together, are drawn by tractor 50, at medial draw plate 53, onto the next adjacent floor slab 20, and the above-described process of erecting another modular concrete shell housing unit 10 is repeated.

The several components of the form assemblies, in the main, are preferably made of steel and, where fixedly attached, the components are generally welded together. Where components are removably secured together, the fasteners preferably comprise bolt, nut and washer elements. The lowermost inner wall form panels 192 are preferably made of aluminum sheet to reduce the weight of the bottom sections 180, which are manually attached to the inner wall form 120. The jack mechanisms 66 and 78 and the air cylinders 146 are of conventional construction, readily available from many material handling equipment supply sources. The reinforcing steel wire grid wall and roof components 242 and 244 respectively are preferably formed of welded wire mesh and, when preassembled into the unit 240, the components are conjoined by wire-tying or welding the contiguous wire rods of the wall and roof sections.

Having disclosed herein certain preferred embodiments of the invention for purposes of explanation, further modifications or variations thereof, after study of this specification, will or may occur or become apparent to persons skilled in the art to which the invention pertains. Reference should be had to the appended claims in determining the scope of the invention.

I claim:

1. Apparatus for constructing an integrally formed concrete shell housing unit having side walls and roof sections on a preforming hardened concrete floor slab, said apparatus including a pair of complementary form assemblies having structural framing portions, and means detachably connected to each said form assembly at the ends thereof for drawing said form assemblies onto said floor slab into transversely aligned parallel contiguous relationship and for removing said assemblies from said floor slab, said apparatus characterized by the improved combination comprising (a) said form assemblies being detachably connected together substantially longitudinally medially of said floor slab at their adjacent structural framing portions to compose a unitary apparatus, (b) a unitary roof form affixed to and supported by each of said framing portions, (c) pivoting roof edge plate sections hingedly mounted on the outer lateral distal edge of said roof form, (d) wheeled means operably mounted on each of said framing portions for moving, elevating, leveling, supporting and lowering said framing portions and said roof form relative to said floor slab, (e) an inner wall form movably supported on each of said framing portions and translatable horizontally from an inner position with respect to said framing portions to an outer position under and in supporting contiguous relationship with the distal edge of said pivoting roof edge plate sections, (f) means affixed to and operatively supported on said framing portions for translating said inner wall form, (g) and inner wall form bottom sections removably attached to said inner wall form at the lower edge portion thereof.

2. Apparatus for constructing an integrally formed concrete shell housing unit having side walls and roof sections on a preformed hardened concrete floor slab having lateral side edge notched ledges and a row of concrete reinforcing wire steel upstanding from said floor slab inwardly adjacent and substantially parallel with each said side edge ledge, said apparatus including a pair of complementary form assemblies having structural framing portions, and means detachably connected to each of said form assemblies at the ends thereof for drawing each of said form assemblies onto said floor slab into transversely aligned parallel contiguous relationship and for removing said form assemblies from said floor slab, said apparatus characterized by the improved combination comprising (a) said form assemblies being detachably connected together substantially longitudinally medially of said floor slab at their adjacent structural framing portions to compose a unitary apparatus, (b) a unitary roof form affixed to and supported by each of said framing portions, (c) a pivoting roof edge plate section hingedly mounted on the outer lateral distal edge of said roof form, (d) wheeled jack mechanism operably mounted on each of said framing portions for moving, elevating, leveling, supporting and lowering said framing portions and said roof form relative to said floor slab, (e) an inner wall form movably supported on each of said framing portions and translatable horizontally from an inner position with respect to said framing portions to an outer position under and in supporting contiguous relationship with the distal edge of said pivoting roof edge plate section, (f) means affixed to and operatively supported on said framing portions for translating said inner wall form, (g) and inner wall form bottom sections removably attached to said inner wall form at the lower edge portion thereof.

3. The apparatus defined in claim 1 or 2, wherein said means for drawing each of said form assemblies onto and from said floor slab comprises a carriage consisting of framing-mounted shackles and springs supporting transversely mounted axles, and wheels rotatable thereon.

4. The apparatus defined in claim 1, wherein said wheeled means mounted on said framing portions translates each said form assembly transversely of and on said floor slab.

5. The apparatus defined in claim 4, wherein said wheeled means for translating each said form assembly transversely of and on said floor slab comprises framing-mounted jack mechanisms to move, elevate, level, support and lower said framing, roof form and wheeled structure on said floor slab.

6. The apparatus defined in claim 1 or 2, including means for detachably connecting said form assemblies together at their inner lateral abutting longitudinally extending framing members.

7. The apparatus defined in claims 1 or 2, wherein each said form assembly is the obverse and counterpart of the other.

8. The apparatus defined in claim 6, wherein said inner lateral abutting framing members comprise back-to-back channel members.

9. The apparatus defined in claims 1 or 2, wherein said structural framing portions further comprises transversely aligned inwardly-directed abutting cantilever beams in telescoping attachment.

10. The apparatus defined in claims 1 or 2, wherein said framing portions comprises a pair of spaced apart, parallel, longitudinally extending main beams connected to a plurality of transverse beams to form a rigid base framing structure, and a plurality of vertical framing columns affixed to said base framing structure, said roof form being fixedly mounted and supported on said columns.

11. The apparatus defined in claims 1 or 2, wherein each said roof form comprises a plurality of spaced apart longitudinally extending beams supported on a plurality of transverse beams affixed thereto, a roof plate sheet overlying said longitudinally extending beams and affixed thereto.

12. The apparatus defined in claim 11, wherein said roof form beams comprise box-shaped beams in cross-sectional configuration.

13. The apparatus defined in claims 1 or 2, wherein said pivoting roof edge plate section comprises a plurality of longitudinally spaced apart bracket members affixed to the lateral distal edge of said roof form, a plurality of gusset plates pivotally secured to said brackets and extending outwardly therefrom, and a roof edge plate sheet overlying said gusset plates and affixed thereto.

14. The apparatus defined in claim 13, wherein said pivoting roof edge plate section further comprises a plurality of rollers affixed to said roof plate thereunder for rolling contact upon the upper side and edge of said inner wall form as the latter form is translated from an inner to an outer position thereunder.

15. The apparatus defined in claim 1, wherein said wheeled means for moving, elevating, leveling, supporting and lowering said framing portions and said roof form comprises manually operable jack mechanisms secured to said structural framing portions in each quadrant of said connected form assemblies.

16. The apparatus defined in claims 2 or 15, wherein said jack mechanisms are operable in pairs in each quadrant of said connected form assemblies, said jack mechanisms having wheels adapted to bear on said floor slab and disposed for rolling movement transversely thereon.

17. The apparatus defined in claim 16, wherein said jack mechanisms are operatively connected in pairs by connecting rods or tubes detachably coupled together by a manually operable coupling.

18. The apparatus defined in claims 1 or 2, wherein said inner wall form comprises a plurality of horizontal, substantially parallel, vertically spaced apart beams secured to a plurality of spaced apart vertical columns, and a plate or panel sheet affixed to and outwardly of said beams and columns.

19. The apparatus defined in claim 18, wherein said inner wall form panel sheet extends downwardly to the medial portion of the lowermost horizontal beam.

20. The apparatus defined in claim 18, wherein said inner wall form beams and columns have a cross-sectional box-shaped configuration.

21. The apparatus defined in claim 1 or 2, wherein said means for translating said inner wall form horizontally comprises
pairs of vertically spaced apart, parallel, substantially horizontal traveling beams connected together by a vertical strut at their proximal ends,
pairs of rollers rotatably mounted in horizontal alignment on selected ones of said columns,
said traveling beams each operatively supported on and between aligned pairs of said rollers for movement laterally outwardly from or inwardly toward said structural framing portions,
the distal ends of said traveling beams being fixedly connected to the inner side of said inner wall form.

22. The apparatus defined in claim 21, wherein said pairs of traveling beams comprise at least two such pairs in spaced apart relationship longitudinally of said structural framing.

23. The apparatus defined in claim 21, wherein said pairs of traveling beams comprise at least three such pairs in longitudinally, substantially equally spaced apart relationship.

24. The apparatus defined in claim 21, including pneumatic or hydraulic means mounted on said structural framing portions and operatively connected to said traveling beams for actuating their movement laterally outwardly from or inwardly toward said framing.

25. The apparatus defined in claim 24, wherein said pneumatic means comprises
an air cylinder mounted on said framing portions for each pair of said traveling beams and operatively connected to a vertical strut affixed to said traveling beams intermediate their longitudinal ends,
a source of pressurized air operatively connected to and communicating with said air cylinders, and
a valve system for said source of pressurized air to control the actuation of said air cylinders.

26. The apparatus defined in claim 22, wherein said inner wall form bottom sections are manually mountable upon and removably attached to said inner wall form at the vertical columns thereof, and each said bottom section comprises
vertical struts removably secured to said inner wall form vertical columns,
horizontally disposed longitudinally extending support members removably secured to said vertical struts,
and a bottom wall plate or panel sheet overlying said horizontally disposed support members and affixed thereto outwardly thereof.

27. The apparatus defined in claim 26, wherein said bottom section vertical struts are telescopically disposed in said inner wall form vertical columns and secured thereto by pins passed through openings in said struts and columns.

28. The apparatus defined in claim 26, wherein the upper horizontal edge of said bottom wall panel sheets abut the lower horizontal edge of said inner wall form panel sheet upon attachment of said bottom sections to said inner wall form.

29. The apparatus defined in claim 11, including a reinforcing wire grid unit for said concrete shell housing unit, disposed in overlying upwardly spaced apart substantially parallel relationship to said roof forms and pivoting roof edge plate section and in outwardly spaced apart parallel relationship to said inner wall forms, at rest upon said floor slab.

30. The apparatus defined in claim 29, wherein said wire grid unit comprises
wall grid side sections and roof grid sections connected together at their adjacent edges,
said roof grid sections disposed in planes substantially parallel to, overlying and spaced slightly above said roof form plate sheet,
said wall side grid sections disposed in vertical planes substantially parallel to and slightly outwardly of said inner wall form panel sheet.

31. The apparatus defined in claims 1 or 2, including an outer wall form disposed on said floor slab, spaced aparat outwardly from said inner wall form and substantially in parallel therewith, comprising
a plurality of horizontal, vertically spaced apart, parallel beams secured to a plurality of spaced apart vertical columns,
a plate or panel sheet affixed to and inwardly of said beams and columns and in opposing facing relationship to said inner wall form,
said panel sheet extending downwardly to said floor slab, and
a soffit form connected to and extending laterally outwardly from said outer wall form panel sheet at its upper edge.

32. The apparatus defined in claim 31, wherein said outer wall form beams and columns have a cross-sectional box-shaped configuration.

33. The apparatus defined in claim 31, including means secured to said outer wall form and bearing on said floor slab to adjust said soffit form vertically for alignment with said roof form and pivoting roof edge plate section.

34. The apparatus defined in claim 30, including an outer wall form disposed on said floor slab, spaced apart outwardly of said reinforcing wire grid wall sections and substantially in parallel therewith.

35. The apparatus defined in claim 34, including wall ties connected to and securing said inner and outer wall forms in vertical substantially parallel relationship.

36. The apparatus defined in claim 31, wherein said soffit form is disposed substantially in alignment with said roof form and pivoting roof edge plate section, and
including gusset plate members affixed to said soffit form thereunder and to said outer wall form horizontal beams for outboard support of said soffit form.

37. The apparatus defined in claim 31, including bracket means affixed to said outer wall form horizontal beams for machine translation of said outer wall form to a position on and withdrawal from said floor slab.

38. The apparatus defined in claims 1 or 2, including a foreshortened modified outer wall form, permitting application of concrete to said inner wall form by spraying, comprising a plurality of horizontal, vertically spaced apart parallel beams secured to a plurality of spaced apart vertical columns, a plate or panel sheet affixed to and inwardly of said beams and columns and in opposing facing relationship to said inner wall form, a soffit form connected to and extending laterally outwardly from said outer wall form panel sheet at its upper edge, and wall ties connected to and securing said modified outer wall form to said inner wall form in supporting vertical substantially parallel relationship.

39. The apparatus defined in claim 38, wherein said modified outer wall form beams and columns have a cross-sectional box-shaped configuration.

40. The apparatus defined in claim 30, including a foreshortened modified outer wall form disposed outwardly of and spaced apart from said reinforcing wire grid wall sections and substantially in parallel therewith, and wall ties connected to said inner wall form and said modified outer wall form to secure said forms in vertical substantially parallel relationship, and to support said modified outer wall form laterally outwardly.

41. The apparatus defined in claim 40, wherein said modified outer wall form beams and columns have a cross-sectional box-shaped configuration.

42. The apparatus defined in claim 40, wherein said soffit form is disposed substantially in alignment with said roof form and pivoting roof edge plate section, and including gusset plate members affixed to said soffit form thereunder and to said modified outer wall form horizontal beams for outboard support of said soffit form.

43. The apparatus defined in claim 38, wherein said outer wall form extends downwardly less than one-third the distance from said roof form to said floor slab.

44. The apparatus defined in claim 40, wherein said outer wall form extends downwardly less than one-third the distance from said roof form to said floor slab.

* * * * *